United States Patent [19]

Lombardi

[11] 3,972,046

[45] July 27, 1976

[54] ANTENNA ARRANGEMENT FOR A SUBMERGED SUBMARINE

[75] Inventor: Anthony Joseph Lombardi, Flanders, N.J.

[73] Assignee: International Telephone and Telegraph Corporation, Nutley, N.J.

[22] Filed: Aug. 25, 1975

[21] Appl. No.: 607,640

[52] U.S. Cl. ..... 343/709; 343/877

[51] Int. Cl.[2] ..... H01Q 1/32

[58] Field of Search ..... 343/709, 710, 877

[56] References Cited

UNITED STATES PATENTS 3,788,255 1/1974 Tennyson ..... 343/709

*Primary Examiner*—Eli Lieberman

*Attorney, Agent, or Firm*—John T. O'Halloran; Peter Van Der Sluys; Alfred C. Hill

[57] ABSTRACT

This antenna arrangement includes a primary buoy connected to the submarine through a first electro-mechanical cable, a secondary buoy carrying an antenna connected to the primary buoy by a second electro-mechanical cable and a system contained within the primary buoy connected to the second cable to automatically control the deploying and the retrieving of the secondary buoy and to provide electrical continuity between the first and second cables. The deployment of the secondary buoy is produced primarily by hydrodynamic forces rather than only hydrostatic forces.

9 Claims, 4 Drawing Figures

ANTENNA ARRANGEMENT FOR A SUBMERGED SUBMARINE

BACKGROUND OF THE INVENTION

This invention relates to antennas and more particularly to an antenna arrangement for a submerged submarine.

Communications between the outside world and a submerged submarine in the past have been achieved through two independent systems. The first system employs a towed buoy that contains a VLF (very low frequency) receiving antenna. The other system employs the deploying of a floating cable to the sea's surface that acts as the antenna. Although both of these systems have performed satisfactorily, they do, however, have objectionable features. For example, to position the receiving antenna on or close to the sea's surface for best radio reception, extremely long lengths of tow cable are required and complex mechanisms are required for deploying and retrieving the cable. The high costs and excessive weight of these two systems are added objections. These objections are attributable to the fact that positioning of the buoys or floating cables is accomplished solely by hydrostatic lift (buoyancy).

SUMMARY OF THE INVENTION

An object of the present invention is to provide an antenna arrangement that overcomes the objections of the two above-mentioned prior art systems.

Another object of the present invention is to employ smaller buoys having higher lift forces by configuring these smaller buoys so that their lift is produced primarily by hydrodynamic forces rather than only hydrostatic forces.

A further object of the present invention is to provide an antenna arrangement utilizing a secondary buoy with means of automatically deploying and retrieving the secondary buoy contained in a primary buoy towed by a submerged submarine.

A feature of the present invention is the provision of an antenna arrangement for a submerged submarine comprising: a primary buoy; a first electro-mechanical cable connecting the primary buoy to the submarine; a secondary buoy carrying an antenna; a second electro-mechanical cable having one end thereof connected to the secondary buoy and the antenna; and a system contained within the primary buoy connected to the other end of the second cable to automatically control the deploying and the retrieving of the secondary buoy and to provide electrical continuity between the first and second cables.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
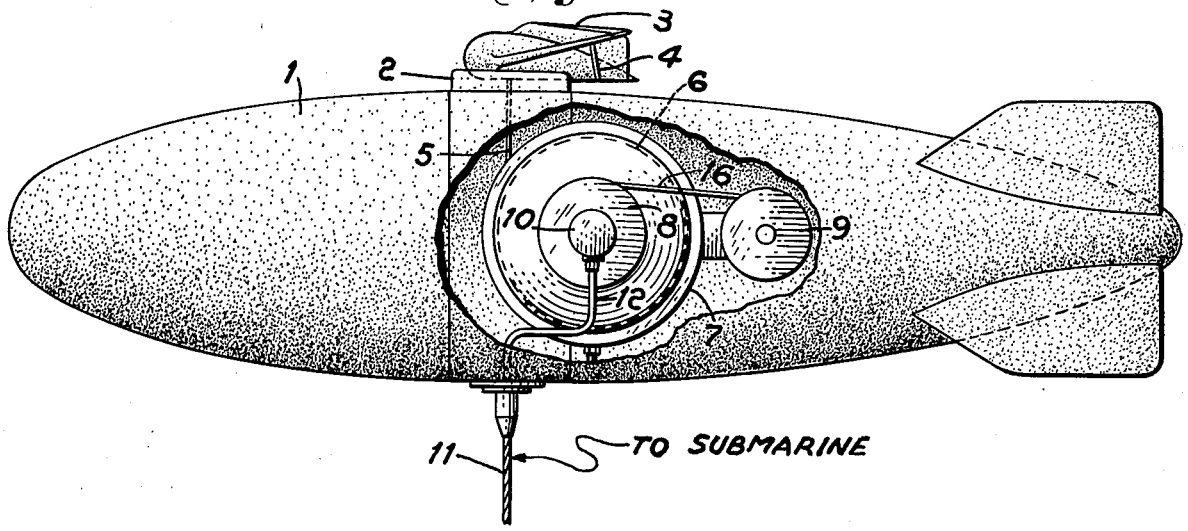
FIG. 1 is a side view of a primary buoy having the hull partially removed therefrom to illustrate the antenna arrangement in accordance with the principles of the present invention.

FIG. 1 illustrates the antenna arrangement of the present invention which includes a hydrodynamically shaped buoy 1, a cradle 2 having disposed therein a secondary buoy 3 which carries an antenna 4, an electro-mechanical tow cable 5 connected to secondary buoy 3 and antenna 4, storage reel 6 disposed in reel housing 7, take-up reels 8 and 9, slip ring assembly 10, submarine electro-mechanical tow cable 11 and RF (radio frequency) cable 12. Electro-mechanical cable 11, RF cable 12, slip ring assembly 10, electro-mechanical cable 5 all cooperate to provide RF continuity between antenna 4 carried by secondary buoy 3 and the radio room of the submerged submarine.

Figure 2:
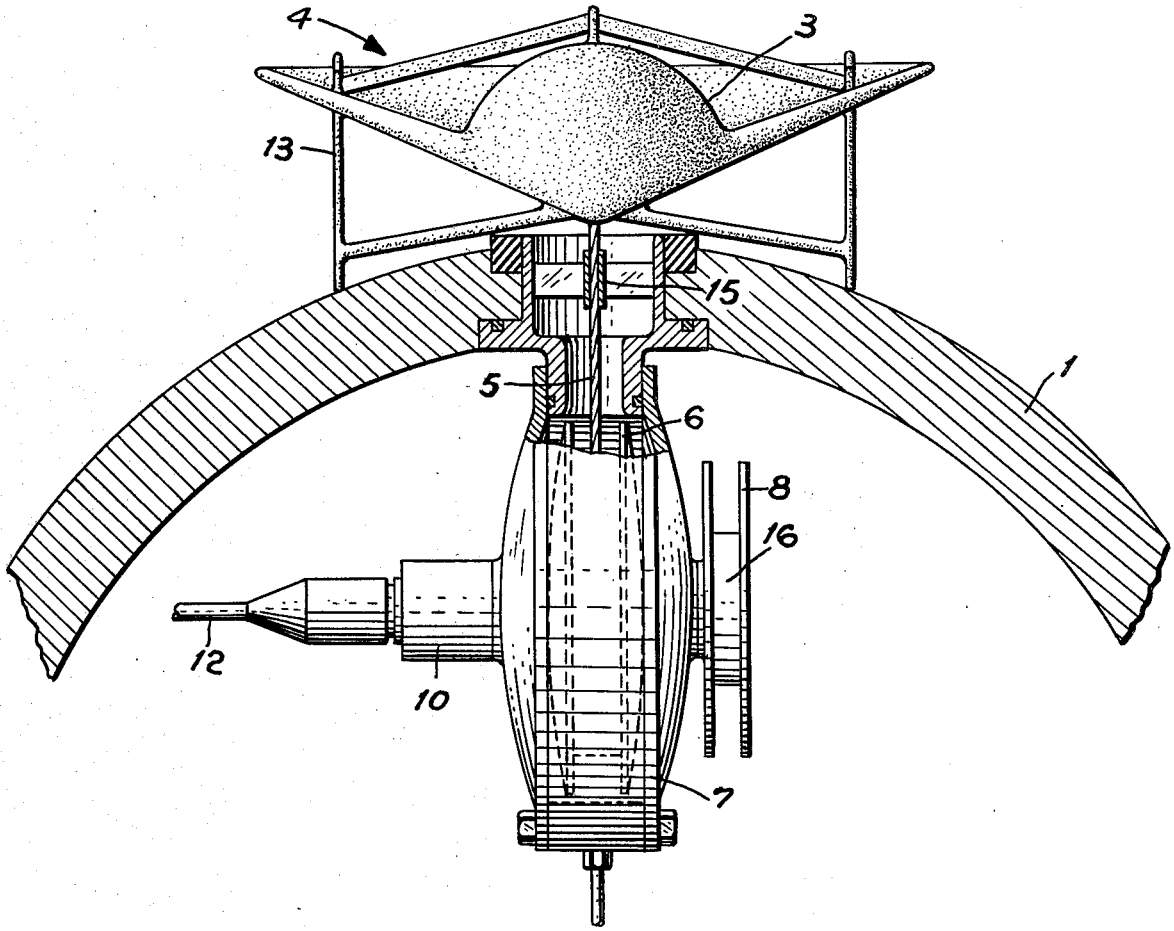
FIG. 2 is a front view of the antenna arrangement of FIG. 1.
Figure 3:
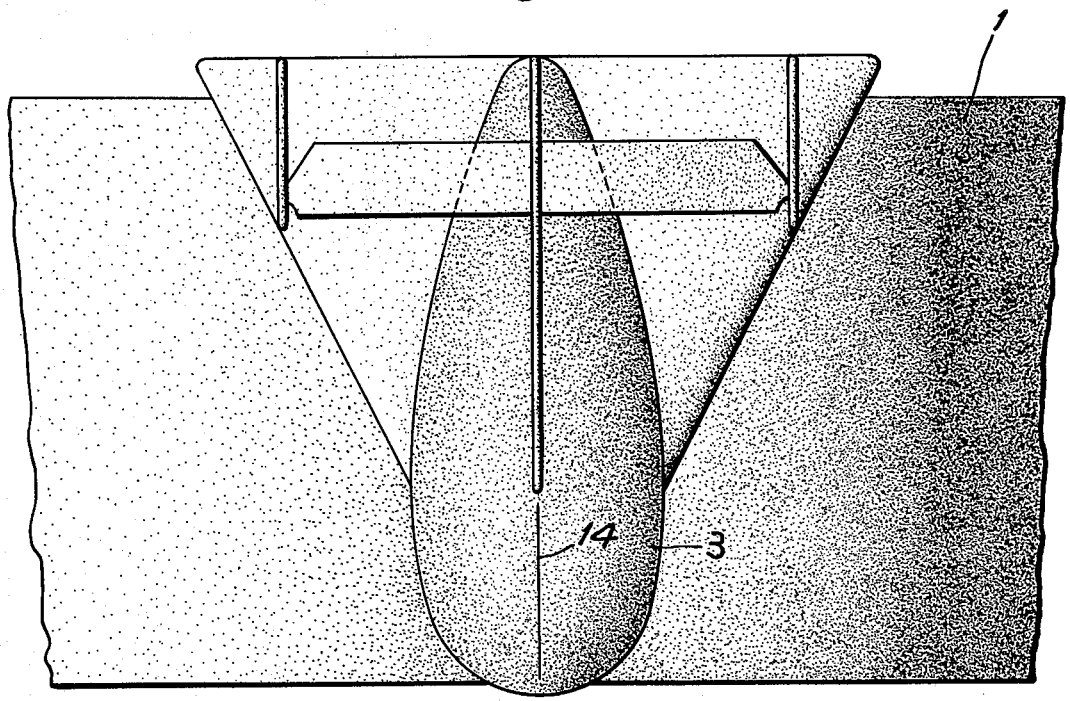
FIG. 3 is a top view of FIG. 2 showing the secondary buoy in accordance with the principles of the present invention.

Referring to FIGS. 2 and 3 there is illustrated a more detailed layout of the salient components required to effect the operations of deploying and retrieving the secondary buoy 3 and its antenna 4 having a component 13 and a component 14 to form a cruciform loop antenna. Buoy 3 is shown in FIG. 2 in its stowed position on buoy 1. Tow cable 5 extends from the tow point on buoy 3 down over guide pulley 15 and attaches to cable reel 6 contained in cable housing 7. Take-up reel 8 is keyed to cable reel 6 so that any motion imparted to take-up reel 8 will be transmitted to cable reel 6 and vice versa. Slip ring assembly 10 is also keyed to cable reel 6. RF cable 12 is connected to tow cable 11 as more particularly illustrated in FIG. 1. Take-up spring 16, shown more clearly in FIG. 1, interconnects take-up reels 8 and 9. Spring 16 provides a constant force acting through tahe-up reels 8 and 9 and storage reel 6 after deployment of the buoy 3 so that this force may be used to retrieve buoy 3.

In order to clearly describe the sequence of operation for the antenna arrangement of this invention, the assumption is made that the following conditions exist: (1) the submarine is fully submerged and travelling at its operational depth and speed; (2) primary buoy 1 is deployed from the submarine and towed approximately 15 feet below the sea's surface; and (3) secondary buoy 3 is stowed on buoy 1.

With the above conditions satisfied, a solenoid operated locking means (not shown) that locks antenna 3 in cradle 2 is actuated from within the submarine thereby freeing buoy 3 to lift off cradle 2. The lifting force on buoy 3 at slow speeds is produced by the buoyancy of buoy 3, while at higher speeds the combination of buoyancy (hydrostatic) and hydrodynamic lift is utilized with the hydrodynamic lift being predominant. The total lift forces in both cases have to be of sufficient strength to overcome the tension created by take-up spring 16.

When this occurs, buoy 3 deploys from buoy 1 until electro-mechanical cable 5 has completly extended itself. A cable clamp (not shown), a part of cable reel 6, prevents electro-mechanical cable 5 from separating from reel 6. Buoy 3 with its antenna 4 stays deployed on the sea's surface until the communications mission is completed. To enable buoy 3 to be retrieved, the speed of the submarine has to be decreased by a predetermined amount which allows take-up spring 16 to overcome the hydrostatic and the hydrodynamic forces on buoy 3. Buoy 3 is then directed to cradle 2 where a seating switch made up of reed switches sealed within buoy 3 (not shown) and permanent magnets attached to cradle 2 (not shown) indicate that the buoy 3 is seated. The solenoid locking means then can be actuated to lock buoy 3 to cradle 2. With buoy 3 in its stowed position on buoy 1, buoy 1 is then reeled in by the submarine and secured to its cradle located on the submarine. The deployment cycle is repeated whenever communications are desired between the outside world and the submerged submarine.

Figure 4:
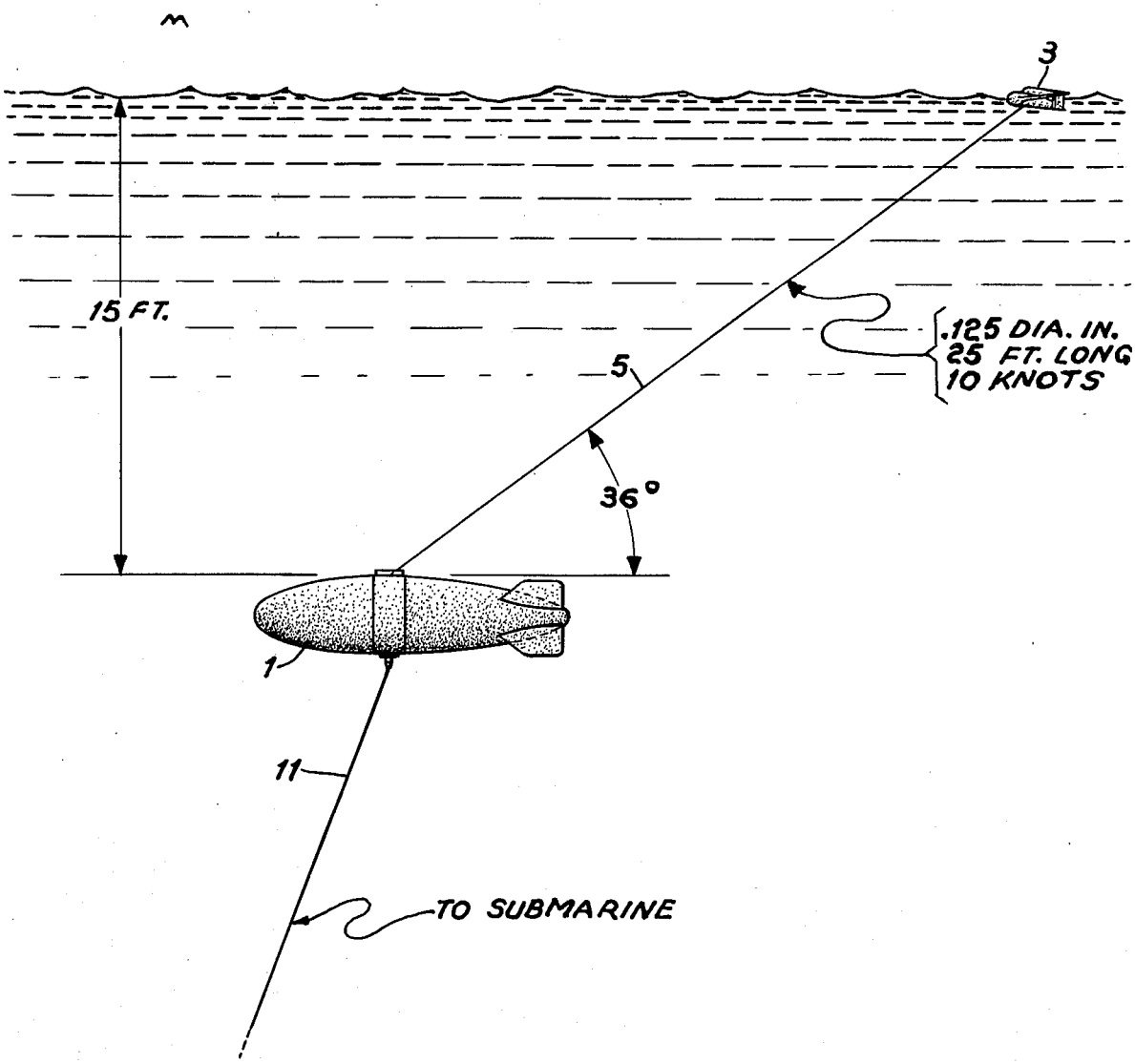
FIG. 4 illustrates various parameters that can be expected when the primary buoy is being towed at a speed of 10 knots.

As shown in FIG. 4, when buoy 1 is towed at a speed of 10 knots only 25 feet of 0.125 inch diameter cable 5 is required when buoy 1 is being towed at a 15 foot depth.

The advantages that are realized by a system of this type are as follows. (1) Deployment and retrieval is simply controlled by the drag forces on the secondary buoy. (2) The electro-mechanical cable 5 is small in diameter (approximately 0.125 inches), therefore, longer lengths can be stored in reel 6. This allows the submarine to travel at greater depths and higher speeds and still maintain the desired reception depth. (3) The maneuverability of the submarine is not jeopardized. (4) For a given performance the arrangement described hereinabove is compact, lighter, functional and less expensive than the prior art arrangements.

While I have described above the principles of my invention in connection with specific apparatus it is to be clearly understood that this description is made only by way of example and not as a limitation to the scope of my invention as set forth in the objects thereof and in the accompanying claims.

I claim:

1. An antenna arrangement for a submerged submarine comprising:

a primary buoy;

a first electro-mechanical cable connecting said primary buoy to said submarine;

a secondary buoy carrying an antenna;

a second electro-mechanical cable having one end thereof connected to said secondary buoy and said antenna; and a system contained within said primary buoy connected to the other end of said second cable to automatically control the deploying and the retrieving of said secondary buoy and to provide electrical continuity between said first and second cables.

2. An arrangement according to claim 1, wherein said secondary buoy is configured to provide a lift primarily by hydrodynamic forces for deployment.

3. An arrangement according to claim 2, wherein said system includes a cable reel connected to said second cable, a guide pulley engaging said second cable to control the movement of said second cable with respect to said cable reel, a first take-up reel connected to said cable reel for axial rotation therewith, a second take-up reel spaced from said cable reel, and a take-up spring interconnecting said first and second take-up reels to have a force imparted thereto by rotation of said cable reel and said first take-up reel when said secondary buoy is deployed by said hydrodynamic forces and to exert a force upon said first take-up reel and said cable reel to retrieve said secondary buoy.

4. An arrangement according to claim 3, wherein said system further includes a slip ring assembly connected to said cable reel, and a radio frequency cable extending from said slip ring assembly to said first cable to provide electrical continuity between said first and second cables.

5. An arrangement according to claim 1, wherein said system includes a cable reel connected to said second cable, a guide pulley engaging said second cable to control the movement of said second cable with respect to said cable reel, a first take-up reel connected to said cable reel for axial rotation therewith, a second take-up reel spaced from said reel cable, and a take-up spring interconnecting said first and second take-up reels to have a force imparted thereto by rotation of said cable reel and said first take-up reel when said secondary buoy is deployed primarily by hydrodynamic forces and to exert a force up said first take-up reel and said cable reel to retrieve said secondary buoy.

6. An arrangement according to claim 5, wherein said system further includes a slip ring assembly connected to said cable reel, and a radio frequency cable extending from said slip ring assembly to said first cable to provide electrical continuity between said first and second cables.

7. An arrangement according to claim 1, wherein said secondary buoy is configured to provide lift for deployment by both hydrostataic force and hydrodynamic force with said hydrodynamic force being predominant.

8. An arrangement according to claim 7, wherein said system includes a cable reel connected to said second cable, a guide pulley engaging said second cable to control the movement of said second cable with respect to said cable reel, a first take-up reel connected to said cable reel for axial rotation therewith, a second take-up reel spaced from said reel cable, and a take-up spring interconnecting said first and second take-up reels to have a force imparted thereto by rotation of said cable reel and said first take-up reel when said secondary buoy is deployed by said hydrostatic and hydrodynamic forces and to exert a force up said first take-up reel and said cable reel to retrieve said secondary buoy.

9. An arrangement according to claim 8, wherein said system further includes a slip ring assembly connected to said cable reel, and a radio frequency cable extending from said slip ring assembly to said first cable to provide electrical continuity between said first and second cables.

* * * * *